US006299505B1

(12) United States Patent
Huang

(10) Patent No.: US 6,299,505 B1
(45) Date of Patent: Oct. 9, 2001

(54) PAD FOR BRASSIERES

(75) Inventor: Hui Lung Huang, Taipei Hsien (TW)

(73) Assignee: Strong Castle Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/633,189

(22) Filed: Aug. 4, 2000

(51) Int. Cl.[7] ..... A41C 3/00
(52) U.S. Cl. ..... 450/57; 450/58
(58) Field of Search ..... 450/1, 57, 58; 2/267, 268

(56) References Cited

U.S. PATENT DOCUMENTS 2,616,093 * 11/1952 Talalay ..... 2/267

* cited by examiner

*Primary Examiner*—Gloria M. Hale
(74) *Attorney, Agent, or Firm*—Dougherty & Troxell

(57) ABSTRACT

An improved pad for brassieres includes a pad that is formed from foamed resin and that is provided with a plurality of slit members.

5 Claims, 5 Drawing Sheets

PAD FOR BRASSIERES

BACKGROUND OF THE INVENTION

1. Field of the Invention

The present invention relates to an improved pad for brassieres, more particularly to a pad with slits.

2. Description of Related Art

For shaping purposes and, to a certain extend, shielding purposes, brassieres are generally equipped with pads to form cups, which are enclosed by a fabric that may have various patterns to appeal to consumers.

A conventional pad for brassieres is formed from foamed resin and has a concave portion and a convex portion so as to adapt to the shape of the breast. Since air-permeability of foamed resin is not good, it is not comfortable to wear brassieres with such pads. In addition, although foamed resin articles provide elasticity and extendibility, since the conventional pad for brassieres is an integral piece, it cannot deform to match the shape of the breast to a satisfactory degree.

Manufacturers have developed a type of pad for brassieres which is perforated, such as that shown in FIG. 1, to try to overcome the air-ventilation problem. However, as the pad has hollows, the contour thereof is not smooth. If only a single layer of fabric is used to enclose the pad, the shielding effect is not good. As such, two layers of fabric have to be used, which means increased material. Besides, the intended air-ventilation effect is affected.

Furthermore, since the pad is only provided with holes, in terms of extendibility, the deforming capability thereof is not improved as compared to pads without holes. Therefore, such a pad does not aid much in terms of deformation to match the shape of the breast.

SUMMARY OF THE INVENTION

Therefore, the object of the present invention is to provide an improved pad for brassieres to overcome the above-mentioned problems.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
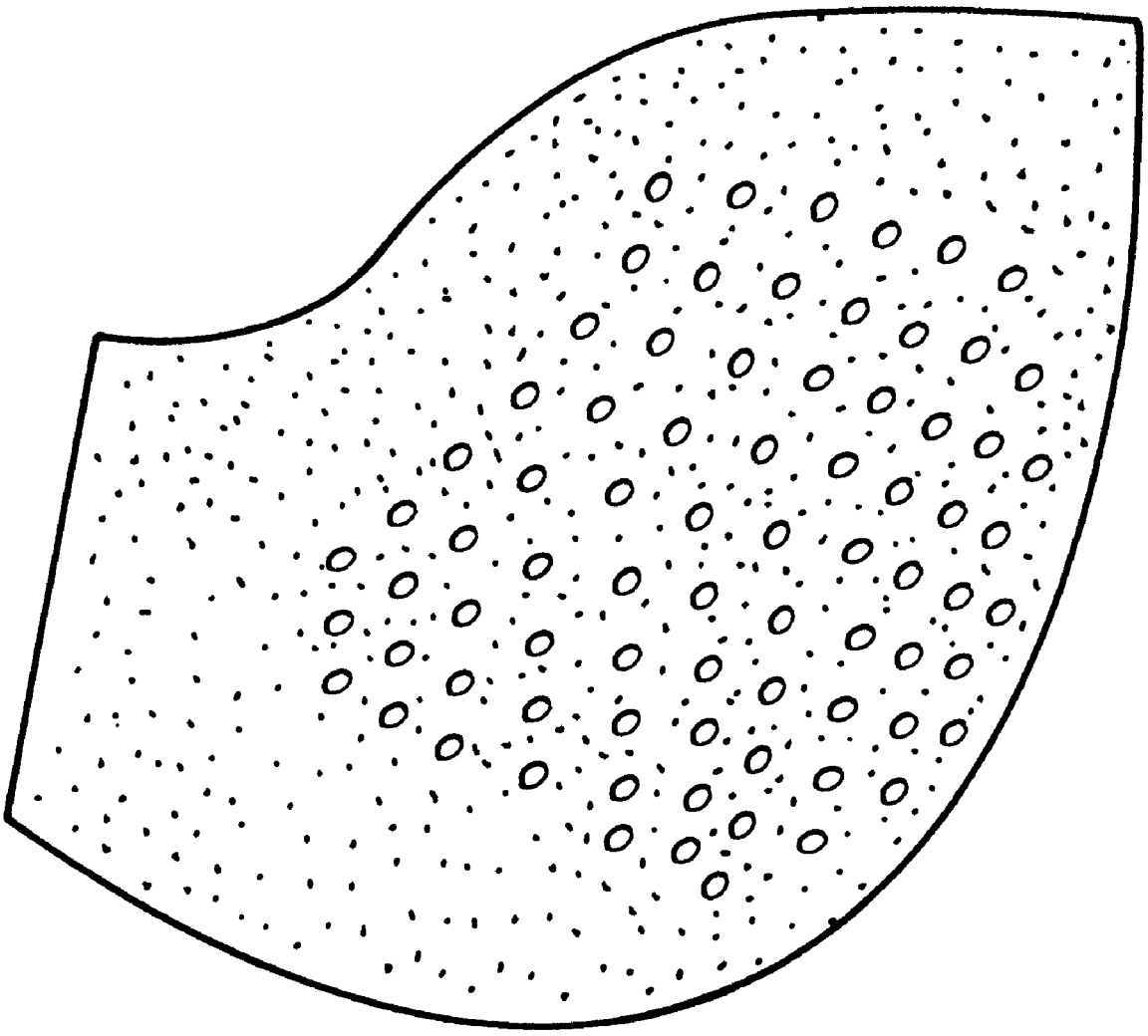
(PRIOR ART) FIG. 1
FIG. 1 is a schematic view of a conventional pad for brassieres.
Figure 2:
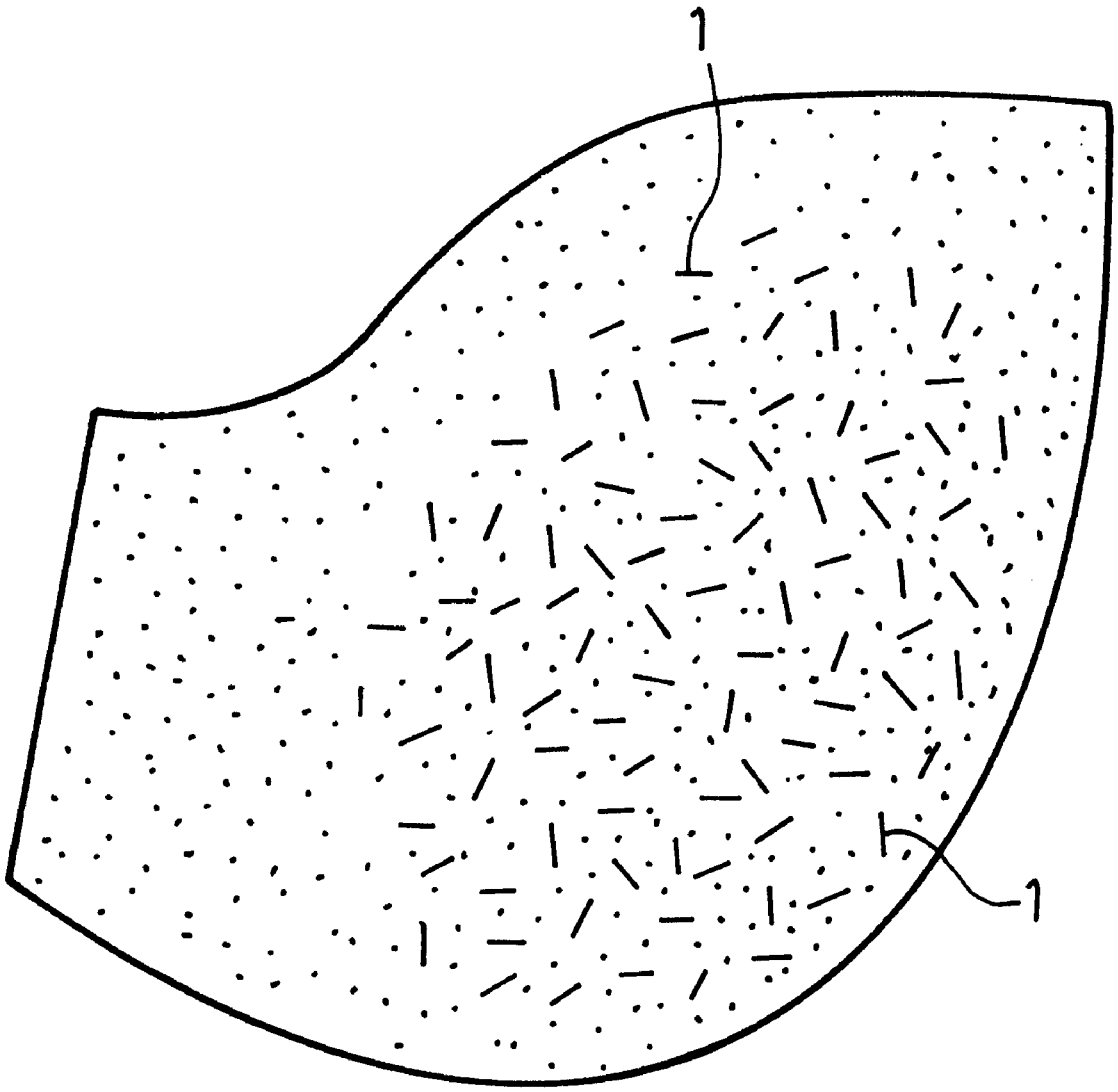
FIG. 2 is a schematic view of an embodiment of a pad of the present invention, which has single slits arranged in a random manner.
Figure 3:
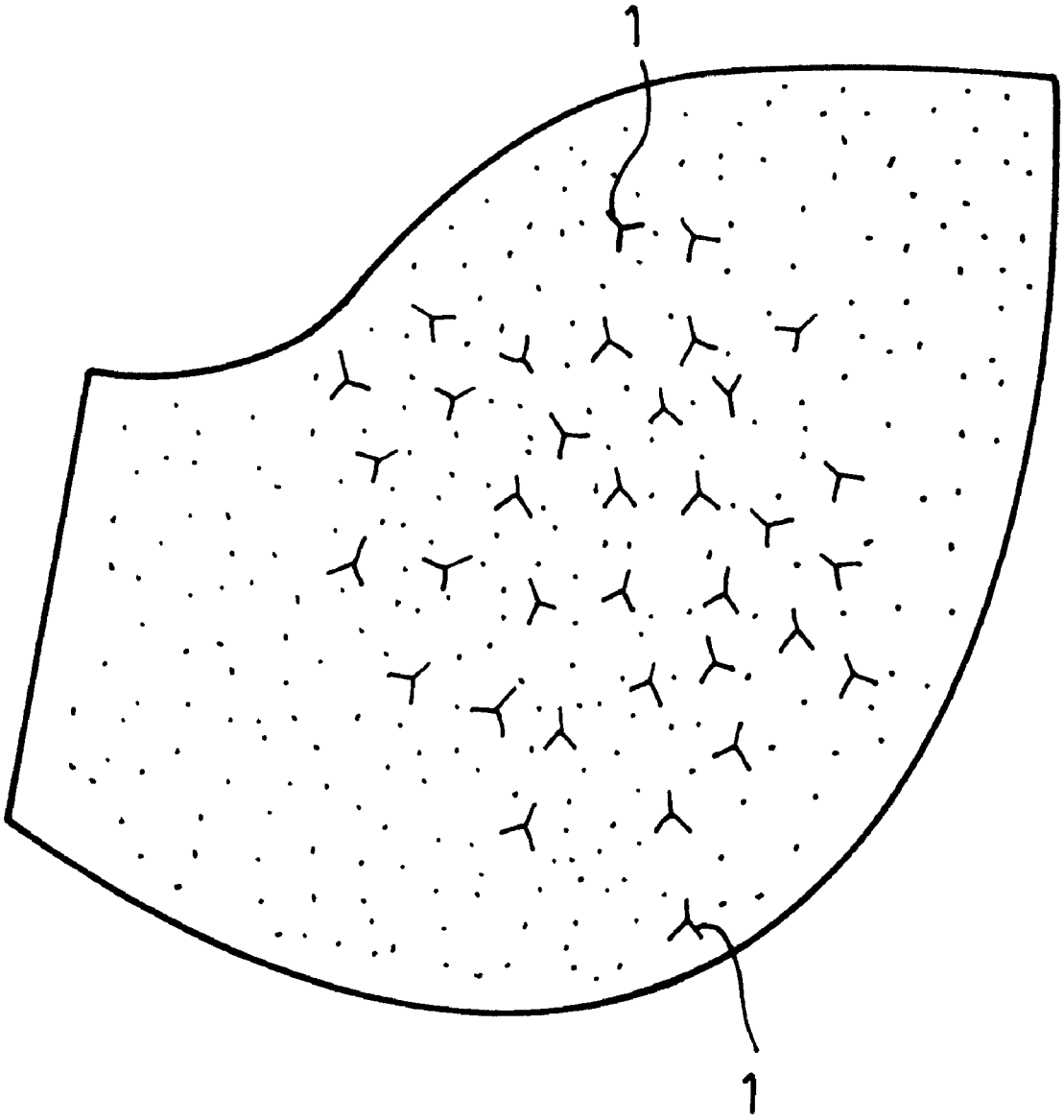
FIG. 3 is a schematic view of another embodiment of the pad of the present invention, which has slit units arranged in a radial pattern.
Figure 4:
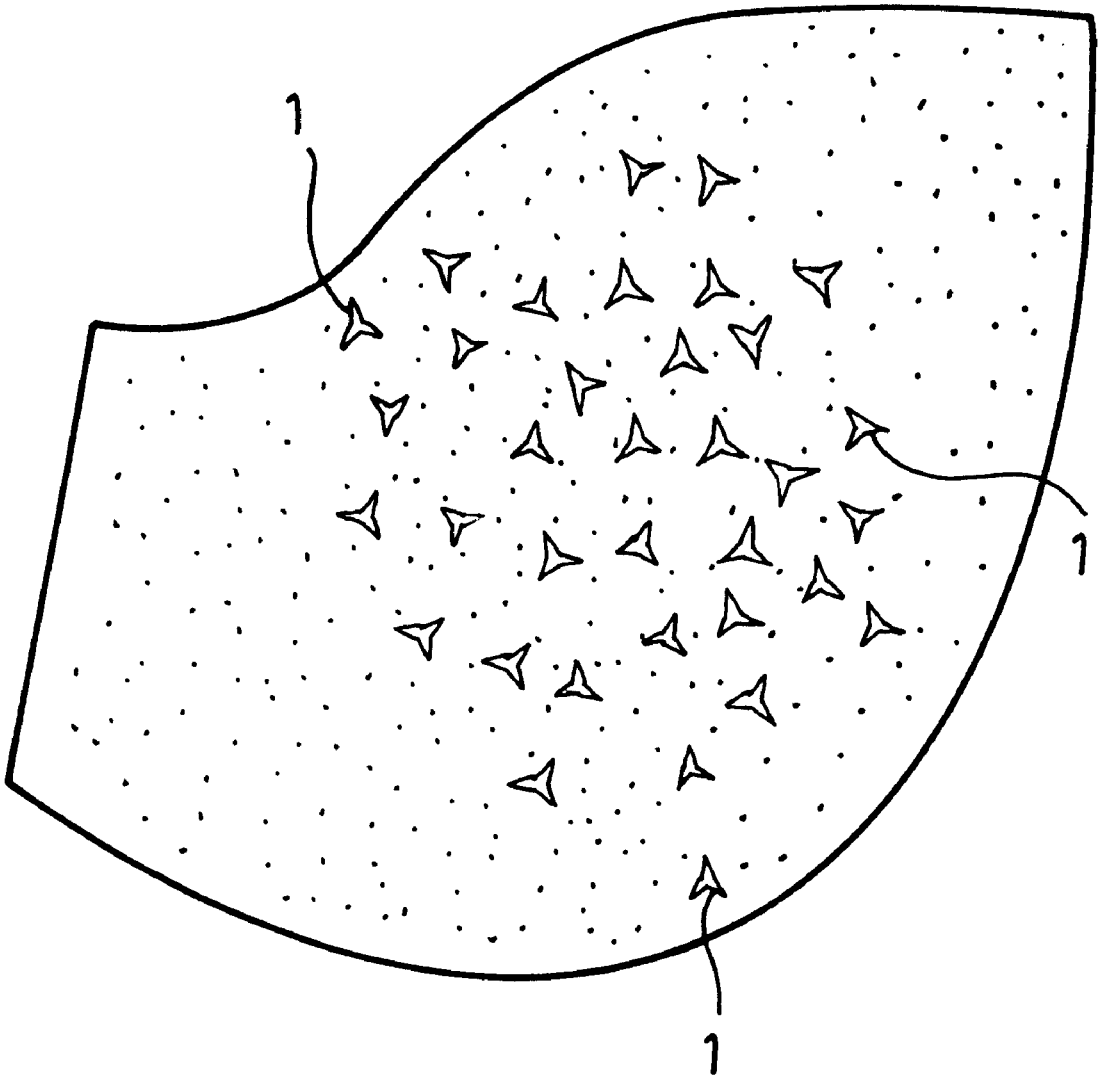
FIG.4 is a schematic view of wearing which shows the expanded slits.
Figure 5A:
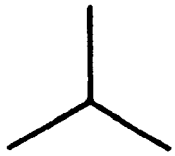
FIGS. 5*a* to 5*h* are the schematic view of varied slits unit arrange in a radial pattern.
Figure 5B:
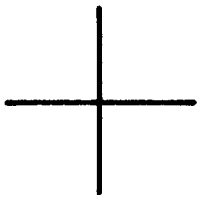
Figure 5C:
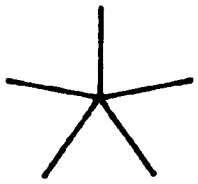
Figure 5D:
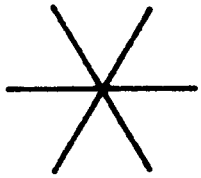
Figure 5E:
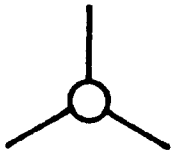
Figure 5F:
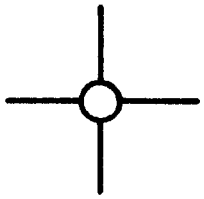
Figure 5G:
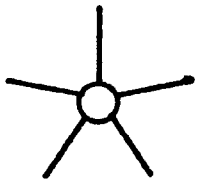
Figure 5H:
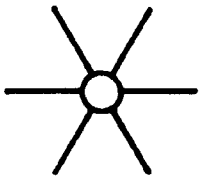

As shown in FIGS. 2 to 4, a pad of the present invention is distinguished from the prior art in that the pad has a plurality of slits or splits 1. The width of each slit member 1 basically depends on the thickness of the blade of the cutting tool used to form the slits 1. In practice, the slits 1 may be made by using a cutter of an automatic machine. Besides, basically, there is not any portion of the pad that is cut off.

Each slit 1 may be a linear one. In terms of distribution, they may be arranged in rows or in different directions, and the arrangement is not restricted to any particular manner or form. As shown in FIG. 3, the pad has slit units 1 that is constituted by three slits which are spaced apart from one another by 120 degrees in a radial manner. It should be understood that the number of slits in each slit unit 1 is not restricted to three, and may be four, five, or more, and there are a plurality of such slit units 1 in the pad.

With additional reference to FIG. 3, since the width of each slit unit 1 is very small, and due to the elasticity of foamed resin, after formation of the slit units 1 in the pad, the slit units 1 cannot be easily detected from the outside. In other words, the surface of the pad is still smooth, unlike the prior art.

With reference to FIG. 4, in use, when the pad is stretched, the slit units 1 will be stretched as well to form tiny holes to permit circulation of air.

In practice, due to the cutter, the size of the center of the slits of the slit unit 1 may be larger than the slit 1. But basically, the slit units 1 will be essentially invisible in appearance. If the cut is not a slanting one, i.e., not perpendicular to the pad, the slit 1 will be barely visible due to the fact that the top opening of the cut and the bottom opening of the cut is not in line.

With reference to FIGS. 5*a* to 5*h,* said slit units 1 can be designed in varied shape and configuration especially with a center hole and the slits radially extending outward from said center hole.

In view of the aforesaid, the present invention can provide an air-ventilating effect. Besides, since the slits 1 are barely visible, there is no need to provide more than one layer of fabric for enclosing the same. Particularly, the pad of the invention can deform to match the shape of the breast.

Although the present invention has been illustrated and described with reference to the preferred embodiment thereof, it should be understood that it is in no way limited to the details of such embodiment but is capable of numerous modifications within the scope of the appended claims.

What is claimed is:

1. A brassiere pad having increased permeability comprising a foamed resin pad having a plurality of slits, each slit movable between closed and open positions when the pad is stretched so as to form holes when in the open position, thereby increasing the permeability of the brassiere pad.

2. The brassiere pad of claim 1 wherein the plurality of slits are randomly distributed in the pad.

3. The brassiere pad of claim 1 wherein each slit is a linear slit when in the closed position.

4. The brassiere pad of claim 1 wherein each slit comprises a plurality of slit segments extending outwardly from a central point.

5. The brassiere pad of claim 4 wherein the central point comprises a center hole.

* * * * *